US006540311B2

(12) United States Patent
Canedy et al.

(10) Patent No.: US 6,540,311 B2
(45) Date of Patent: Apr. 1, 2003

(54) DISPLAY CASE SECURITY APPARATUS

(75) Inventors: John F. Canedy, Rowlett, TX (US); Leo Faubion, Plano, TX (US); Paul Lenox, Mesquite, TX (US); Larry G. Stanford, Coppell, TX (US)

(73) Assignee: Faubion Associates, Inc., Dallas, TX (US)

( * ) Notice: Subject to any disclaimer, the term of this patent is extended or adjusted under 35 U.S.C. 154(b) by 0 days.

(21) Appl. No.: 09/997,401

(22) Filed: Nov. 29, 2001

(65) Prior Publication Data

US 2002/0079788 A1 Jun. 27, 2002

Related U.S. Application Data

(60) Provisional application No. 60/250,038, filed on Nov. 29, 2000.

(51) Int. Cl.[7] ..... A47F 3/00

(52) U.S. Cl. ..... 312/114; 312/312; 312/319.7; 108/147

(58) Field of Search ..... 312/114, 117, 312/138.1, 312, 306, 319.5, 319.7; 108/147, 144.11; 109/47

(56) References Cited

U.S. PATENT DOCUMENTS

| | | | |
|---|---|---|---|
| 145,378 | A | 12/1873 | Wilkins |
| 328,475 | A | 10/1885 | Ford |
| 1,441,763 | A | 1/1923 | Stinson |

(List continued on next page.)

FOREIGN PATENT DOCUMENTS

| | | |
|---|---|---|
| DE | 45974 | 1/1911 |
| DE | 2202785 | 8/1973 |
| EP | 0 521 728 A1 | 1/1993 |
| FR | 2619695 A1 | 3/1989 |
| GB | 668942 | 3/1952 |
| JP | 52-7700 | 1/1977 |
| JP | 408336449 A | 12/1996 |

*Primary Examiner*—Lanna Mai
*Assistant Examiner*—Jerry A. Anderson
(74) *Attorney, Agent, or Firm*—Howison & Arnott, L.L.P.

(57) ABSTRACT

A display case security apparatus comprises a housing, a plurality of platform guide tracks, a platform, an elevating mechanism, and a closure. The housing includes a lower storage section and an upper display section disposed above the storage section. The storage section has an opaque exterior wall and the display section has an exterior wall which is at least partially transparent. The platform guide tracks are disposed on the interior of the housing. The platform is disposed within the housing and includes a generally horizontal portion for supporting articles to be displayed. The platform is selectively movable between a first position, wherein any articles supported on the platform are displayed in the display section of the housing, and a second position, wherein any articles supported on the platform are stored in the storage section of the housing. The platform interfits with the platform guide tracks so as to constrain the movement of the platform to vertical translation only. The elevating mechanism is mounted within the storage section and connected to the platform. The elevating mechanism includes a rotatable crankshaft and at least one pair of links. The first link of each pair of links has a first end which engages the crankshaft so as to rotate with crankshaft and a second end which is pivotally connected to a first end of the second link of each pair of links. Each of the second links has a second end which is pivotally connected to the platform, whereby the platform moves between the first position and the second position when the crankshaft rotates. The closure is selectively interposed between the display section and the storage section when the platform is in the second position, whereby the platform and any articles supported thereon are enclosed within the storage section of the housing.

27 Claims, 12 Drawing Sheets

U.S. PATENT DOCUMENTS

| | | | | | |
|---|---|---|---|---|---|
| 1,949,954 | A | | 3/1934 | Culler et al. | |
| 1,990,300 | A | * | 2/1935 | Miller | 312/409 |
| 2,201,948 | A | | 5/1940 | Watkins | |
| 2,284,531 | A | | 5/1942 | Miller et al. | |
| 2,569,254 | A | | 9/1951 | Page | |
| 2,687,934 | A | | 8/1954 | Gipple | |
| 3,805,962 | A | * | 4/1974 | Bendiksen | 211/4 |
| 4,022,137 | A | | 5/1977 | Chiu | |
| 4,369,717 | A | | 1/1983 | Bollier | |
| 5,129,611 | A | | 7/1992 | Grover et al. | |
| 5,165,768 | A | | 11/1992 | Zarrabi et al. | |
| 5,295,743 | A | | 3/1994 | Moulton et al. | |
| 5,483,905 | A | | 1/1996 | Johansson | |
| 5,524,977 | A | | 6/1996 | Orawski | |
| 5,733,021 | A | | 3/1998 | O'Neill et al. | |
| 5,758,936 | A | | 6/1998 | Baughan | |
| 5,791,749 | A | | 8/1998 | O'Neill et al. | |
| 5,820,233 | A | * | 10/1998 | Hahn | 312/114 |
| 5,853,235 | A | | 12/1998 | Barnes | |
| 6,102,355 | A | | 8/2000 | Rood | |

* cited by examiner

DISPLAY CASE SECURITY APPARATUS

CROSS-REFERENCE TO RELATED APPLICATIONS

This application is related to, and claims the benefits of priority from U.S. Provisional Patent Application Ser. No. 60/250,038, entitled "DISPLAY CASE SECURITY APPARATUS", filed Nov. 29, 2000.

TECHNICAL FIELD OF THE INVENTION

This invention relates to a display case or cabinet having a moveable platform for supporting valuable articles such as jewelry. In one aspect, it relates to a mechanism for selectively moving the platform between a display portion and a secure storage portion of the case.

BACKGROUND OF THE INVENTION

Display cases, also known as showcases, are widely used for displaying high-value articles such as jewelry, coins, electronics, cameras, etc. It is readily understood that the typical display case having one or more glass windows is particularly susceptible to theft wherein the criminal smashes the glass and removes as many valuable articles as possible before escaping. Due to the frequency of such "smash and grab" crimes, most retailers choose to remove high-value goods from their display cases at the close of business daily and relocate the merchandise into more secure storage. Unfortunately, the routine transfer of merchandise between the display case and storage causes many problems of its own, not the least of which is the increased labor required to perform the work. Other problems include increased wear and tear on the merchandise and display fixtures, and increase problems with inventory and loss control.

Accordingly, it would be of significant advantage to provide a display case which would secure the merchandise from possible theft without requiring the removal of the merchandise after business hours.

Numerous inventors have addressed the problem outlined above. For example, U.S. Pat. Nos. 5,733,021 and 5,791,749 disclose variations of a theft resistant display case, which uses an electric scissor lift mechanism to raise and lower a display platform between an upper display portion of the showcase and a lower storage portion. After the display platform is lowered into the storage portion, a multipiece closure may be interposed between the upper portion and the lower portion to enclose the merchandise in the lower storage portion, where it is more secure from theft. U.S. Pat. No. 5,853,235 discloses a burglar proof jewelry case having an upper and lower portion separated by a hinged display shelf. When a solenoid is energized, (e.g., in association with a burglar alarm), the shelf swings downward and any jewelry sitting on the shelf falls into the lower chamber where it becomes unreachable by a thief. While these and other devices have addressed some of the problems associated with the secure storage of jewelry and other valuables, many problems remain to be solved. For example, the actuating mechanisms of these devices, e.g., the electric scissor lift, tend to be overly complex, expensive and prone to failure. Further, these devices typically require electricity from wall outlets for the actuation of the various mechanisms, which can detrimentally affect cost and reliability. In many cases, the closures used to separate the display portion of the case from the storage portion of the case may be a heavy, complex device having tens or hundreds of components which greatly increases its manufacturing cost. Further, these closures maybe too heavy for the average sales person to operate such that electrical power is needed to move the closure as well as to operate the display platform. A need therefor exists for display case security apparatus which overcomes the obstacles or shortcomings of the prior art.

SUMMARY OF THE INVENTION

The present invention disclosed and claimed herein comprises, in one aspect thereof, a display case security apparatus comprising a housing, a plurality of platform guide tracks, a platform, an elevating mechanism, and a closure. The housing includes a lower storage section and an upper display section disposed above the storage section. The storage section has an opaque exterior wall and the display section has an exterior wall which is at least partially transparent. The platform guide tracks are disposed on the interior of the housing. The platform is disposed within the housing and includes a generally horizontal portion for supporting articles to be displayed. The platform is selectively movable between a first position, wherein any articles supported on the platform are displayed in the display section of the housing, and a second position, wherein any articles supported on the platform are stored in the storage section of the housing. The platform interfits with the platform guide tracks so as to constrain the movement of the platform to vertical translation only. The elevating mechanism is mounted within the storage section and connected to the platform. The elevating mechanism includes a rotatable crankshaft and at least one pair of links. The first link of each pair of links has a first end which engages the crankshaft so as to rotate with crankshaft and a second end which is pivotally connected to a first end of the second link of each pair of links. Each of the second links has a second end which is pivotally connected to the platform, whereby the platform moves between the first position and the second position when the crankshaft rotates. The closure is selectively interposed between the display section and the storage section when the platform is in the second position, whereby the platform and any articles supported thereon are enclosed within the storage section of the housing.

BRIEF DESCRIPTION OF THE DRAWINGS

For a more complete understanding of the present invention and the advantages thereof, reference is now made to the following description taken in conjunction with the accompanying Drawings in which:

FIG. 1 illustrates a front perspective view of the apparatus;

FIG. 2 illustrates a rear elevation view;

FIG. 3 illustrates a cross-sectional side elevation view;

FIG. 4 is a front perspective view;

FIG. 5 is a rear elevation view with portions of the rear wall broken away to show interior details of the storage section;

FIG. 6 is a cross-sectional side elevation view;

FIG. 10 is a rear elevation view;

FIG. 11 is a front elevation view;

FIG. 12 is a cross-sectional front view with the platform in the raised position;

FIG. 13 is a cross-sectional side elevation view with the platform in the raised position;

FIG. 14 is a cross-sectional side view with the platform in the lowered position;

FIG. 15 is a cross-sectional side elevation view with the platform in the lowered position;

FIG. 16 is a rear elevation view;

FIG. 17 is a front elevation view;

FIG. 18 is a cross-sectional front view with the platform in the raised position;

FIG. 19 is a cross-sectional side elevation view with the platform in the raised position;

FIG. 20 is a cross-sectional front view with the platform in the lowered position;

FIG. 21 is a cross-sectional side elevation view with the platform in the down position.

DETAILED DESCRIPTION OF THE INVENTION

Figure 1:
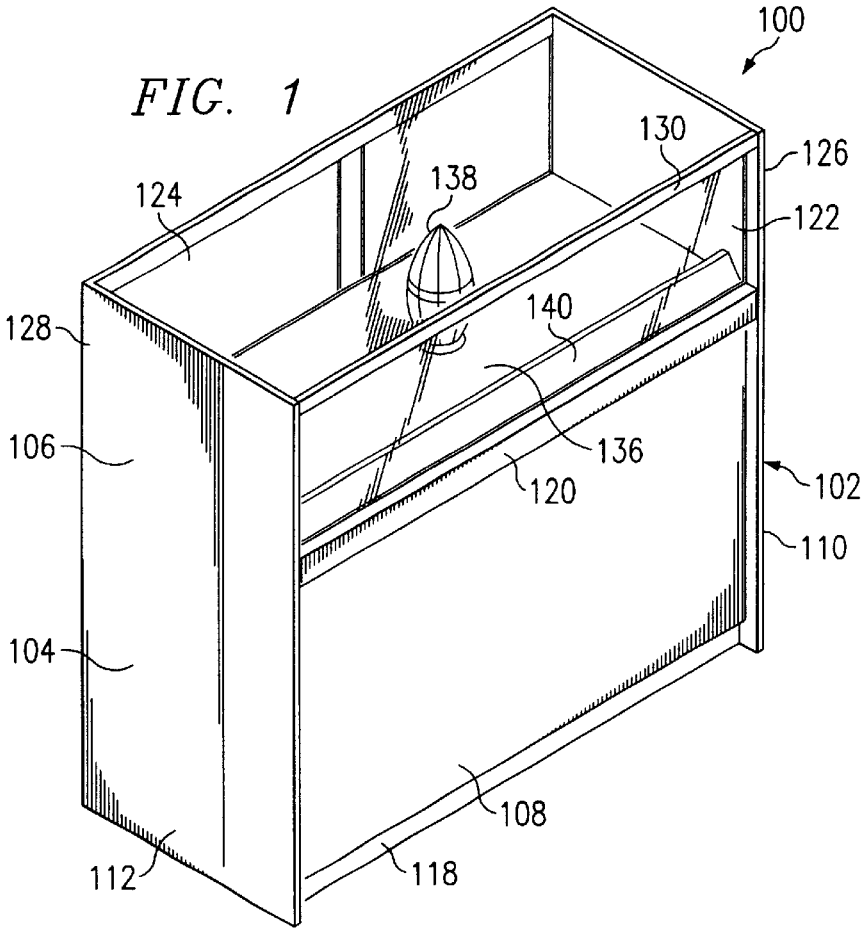
FIGS. 1–3 illustrate one embodiment of a display case security apparatus wherein the platform is in the raised position. Specifically.
Figure 2:
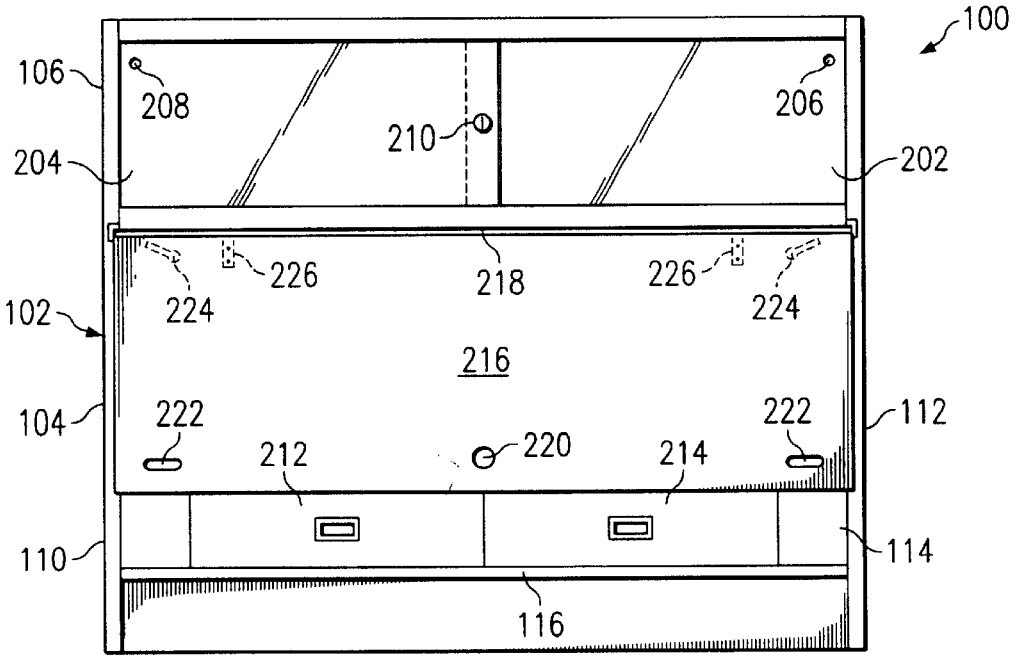
Figure 6:
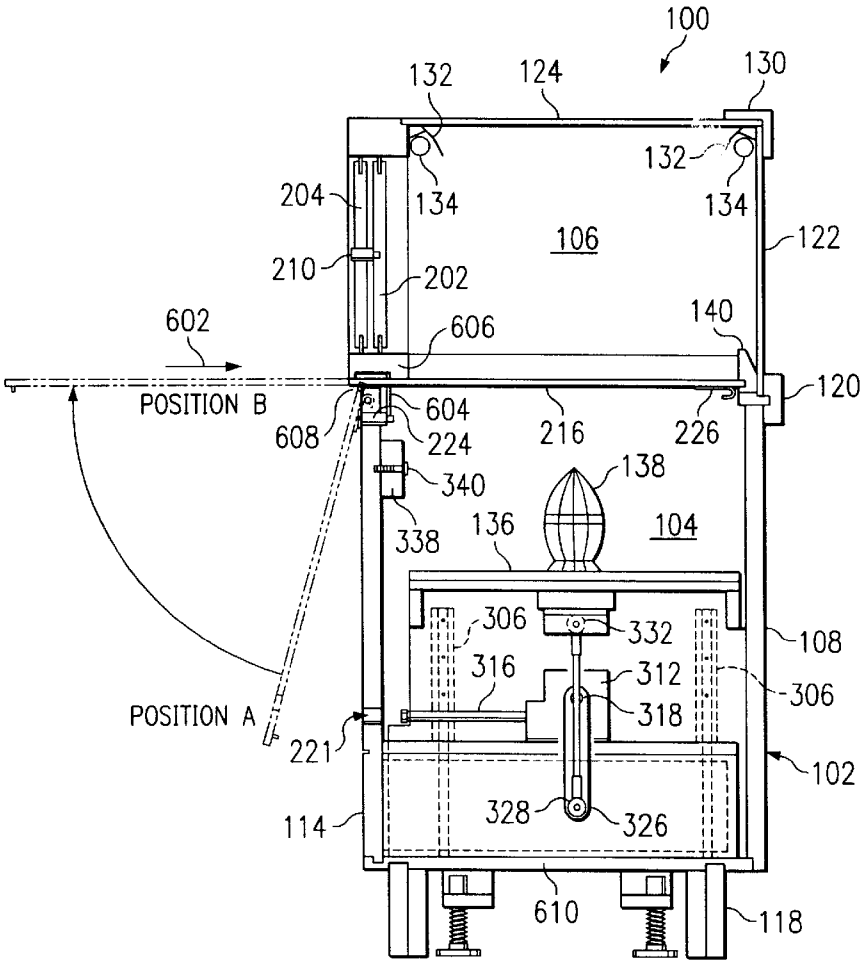
FIGS. 4–6 illustrate the display case security apparatus of FIG. 1 wherein the platform is in the lowered position. Specifically.
Figure 3:
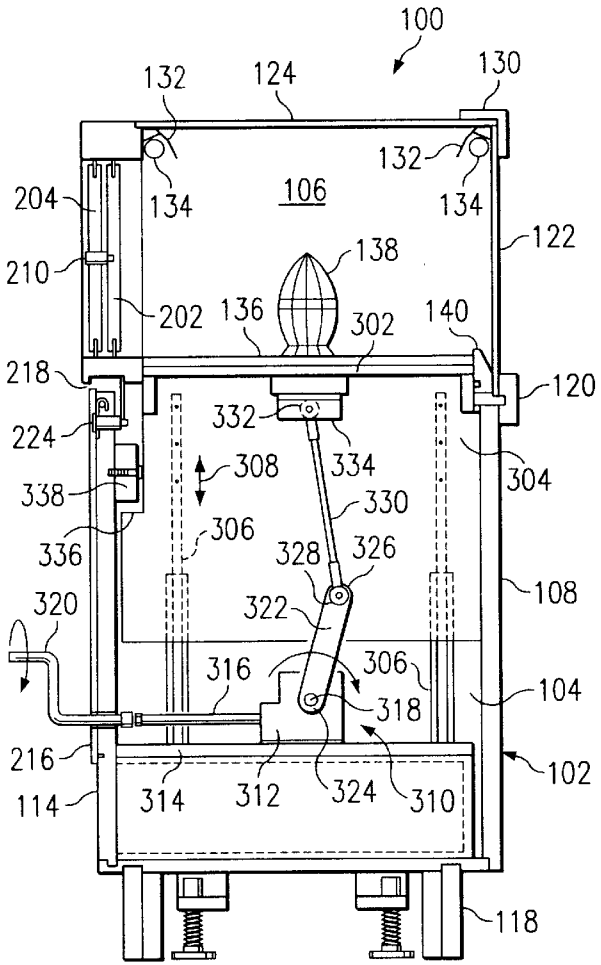
Figure 4:
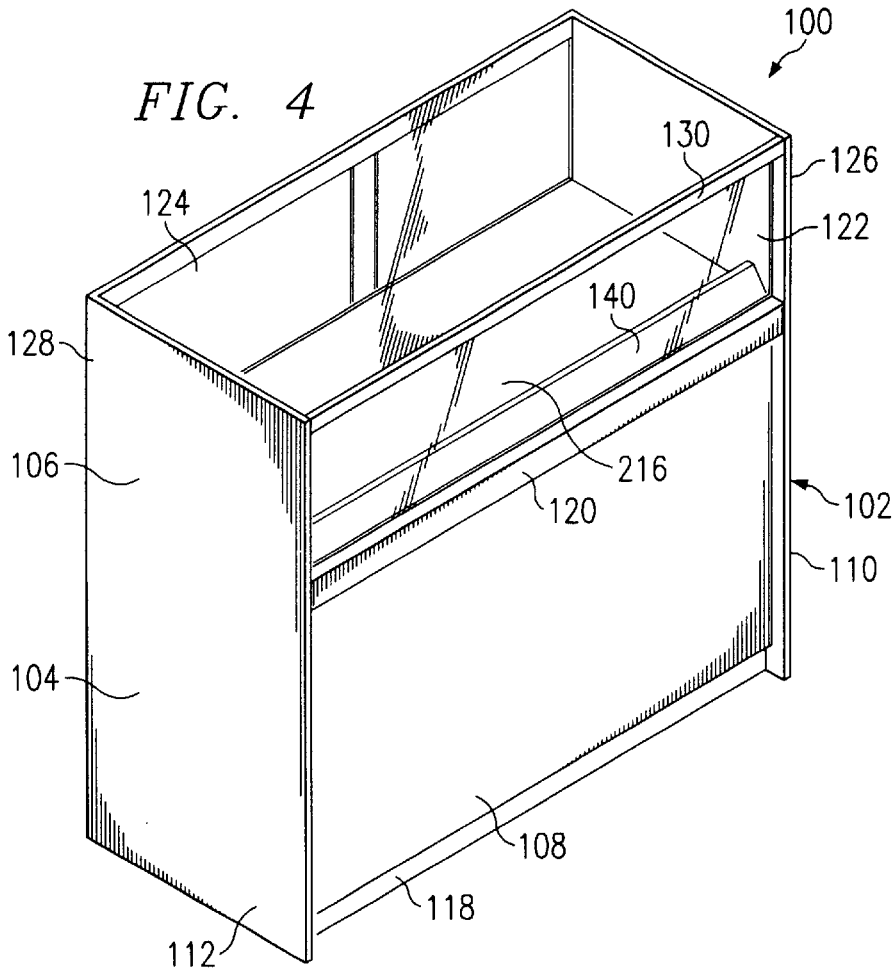
Figure 5:
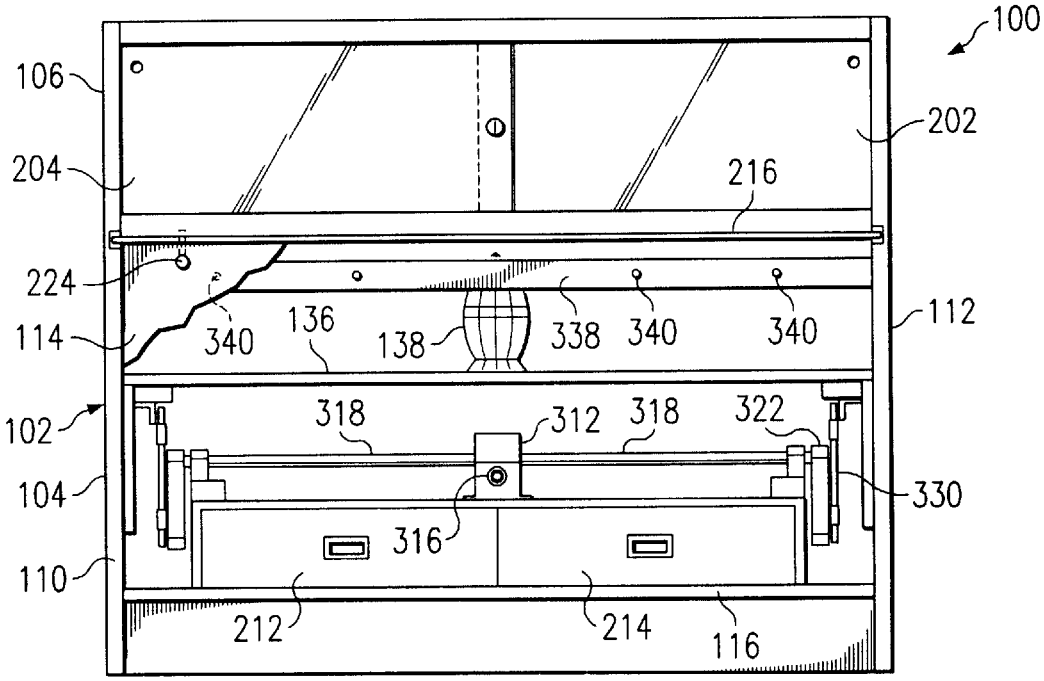

Referring now generally to FIGS. 1–6, there is illustrated one embodiment of a display case security apparatus in accordance with the current invention. In FIGS. 1–3, the apparatus is illustrated with the movable platform in the raised position. In FIGS. 4–6, the apparatus is illustrated with the platform in the lowered position. The display case security apparatus 100 comprises a housing 102 including a lower storage section 104 and an upper display section 106. The lower storage section 104 is defined by four interconnected exterior walls 108, 110, 112, and 114 that form the front, sides and rear of the storage section, respectively. The exterior walls surround a floor 116 (FIG. 2) that is disposed above a base 118. In the embodiment shown, the upper edge of the lower section 104 mounts a trim rail 120 that extends across the front of the display case and finds the lower boundary of the display section 106.

Referring specifically to FIG. 1, the exterior walls 108, 110, 112 and 114 that form the storage section 104 are typically constructed of a suitable wood, wood laminate (e.g., plywood), or wood composite (e.g., particle board) material. In some embodiments, fiberglass, metal or composite combinations of these materials may be used for the walls of the storage compartment. Regardless of the material used, the walls of the lower section should be opaque so that any articles stored in the storage section 104 will be hidden from view.

The display section 106 is generally constructed in accordance with conventional display case construction practices. Accordingly, the display section 106 has exterior walls which are at least partially transparent. It will be understood that in this context, a wall which is at least partially transparent means that at least a portion of the wall is entirely transparent. Typically, the front wall 122 and the top wall 124 will be entirely transparent, constructed of tempered or laminated glass. Alternatively, Lexan or other break resistant plastic materials may be used. The remaining walls of the display section 106 may be either fully transparent, partially transparent, or opaque, as desired. In the embodiment shown, the upper side walls 126 and 128 are unitarily formed with the corresponding lower side wall 110 and 112 respectively. The walls of the display section 106 may be joined together by frame members in a conventional manner. In the embodiment illustrated, a metal frame member 130 is provided to join the front wall 122 and the top wall 124. A light reflector 132 and light 134 may be inconspicuously positioned behind the frame member 130 in order to provide illumination for the inside of the display case.

As best seen in FIG. 2, access into the display section 106 may be provided through one or more display doors formed in the rear of the case. In the embodiment shown, two sliding doors 202, 204 are provided. A pair of finger pulls 206, 208 are provided on the rear surface of the door to facilitate their operation and a conventional cylinder lock 210 is provided for securing the doors in the locked position. It will of course be appreciated that the lock 210 provides only conventional security for the goods within the display case, i.e., they are still susceptible to a "smash and grab" type theft. The primary security of the apparatus 100 lies in the improved moveable platform mechanism as described further below.

A platform 136 is disposed within the housing. The platform 136 includes a generally horizontal portion 302 for supporting articles to be displayed, e.g., article 138. The platform 136 is selectively moveable within the housing 102 as will be further described below. When in the raised position, i.e., as shown FIG. 1, the platform 136 forms the apparent floor of the upper display section 106. A sign shelf 140 may also be provided within the upper display section 106. The sign shelf 140 typically slants rearwardly into the interior of the display section to conveniently support manufacturer's logos, price information, sample products, and/or similar advertising/promotional materials. It will be appreciated that the sign shelf 140 is fixed to the interior of the housing 102 and does not move with the platform 136.

One or more convenience drawers may be provided in the lower portion of the display case housing 102. In the embodiment shown, two convenience drawers 212, 214 are provided. It will be noted that the convenience drawers do not constitute a portion of the lower storage section 104, because they are accessible from the exterior of the housing 102. Instead, these drawers merely provide additional storage space for extra stock or items which would not normally be stored within the display case. As will be shown and described in further detail below, the housing 314 for the convenience drawers 212, 214 actually forms a portion of the floor of the lower storage section 104.

A closure plate 216 may be stored against the rear wall 114 of the housing. In the embodiment shown, the closure plate 216 comprises a one-piece sheet of aluminum which can be inserted into the closure slot 218 extending across the back of the housing 102. An elevating mechanisms aperture 220 is provided on the closure plate 216 which, in cooperation with a corresponding rear wall aperture 221 (FIG. 6) formed in the rear wall 114, allows access to the elevating mechanism 310 housed within the lower storage section 104. Locking slots 222 are also formed through the closure plate 216. The locking slots 222 are engaged by cam locks 224 (shown in phantom) which are mounted in the rear wall 114 of the case. The cam locks 224 are exposed for use when the closure plate 216 has been inserted into the closure slot 218 (as best seen in FIG. 4). One or more hinges 226 may be provided on the closure plate 216 to facilitate its storage on the rear of the case 102 and to further facilitate the correct positioning of the plate prior to its insertion into the closure slot 218.

Referring now specifically to FIG. 3, the interior components and operating mechanisms of the display case security apparatus 100 will be further described. As previously described, the platform 136 includes a generally horizontal portion 302 for supporting articles, e.g., article 138. In this embodiment, the platform 136 further includes end members 304 having a generally vertical orientation. A plurality of platform guide tracks 306 are attached to the interior walls of the housing 102. In the embodiment shown, the guide tracks 306 comprise a ball-bearing equipped track of the type commonly used for guiding drawers (also known as a drawer "glide"). The purpose of the platform guide tracks 306 is to interfit or cooperate with the platform 136 so as to constrain movement of the platform to a vertical translation only. In other words, the guide tracks 306 ensure that the platform 136 can translate vertically (in the direction indicated by arrow 308) while maintaining its orientation. Thus, the generally horizontal portion 302 of the platform 136 will maintain its generally horizontal orientation independent of the vertical movement of the platform.

The platform 136 is thus selectively moveable between a first position (i.e., that shown in FIGS. 1–3) wherein any articles supported on the platform are displayed in the display section 106 of the housing, and a second position (i.e., that shown in FIGS. 4–6) wherein any article supported on the platform are stored in the storage section 104 of the housing. A lift or elevating mechanism 310 is mounted within the storage section and connected to the platform 136.

Figure 7:
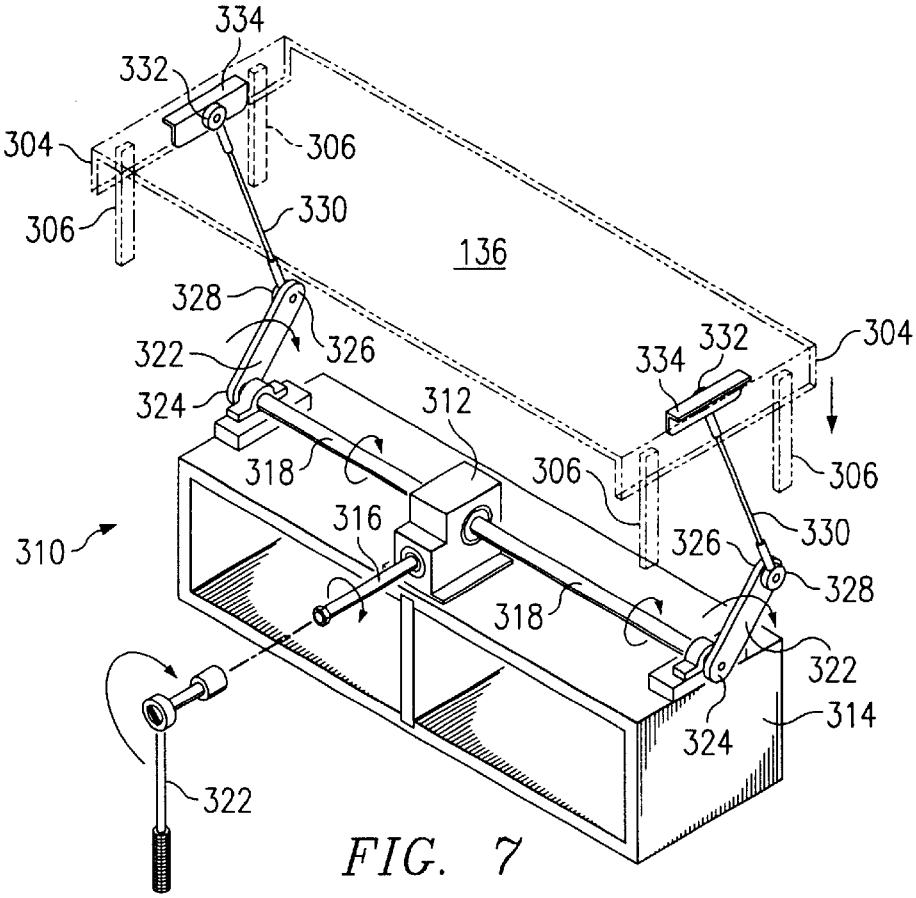
FIG. 7 is a perspective diagram illustrating one embodiment of an elevating mechanism suitable for use in the apparatus.
Figure 10:
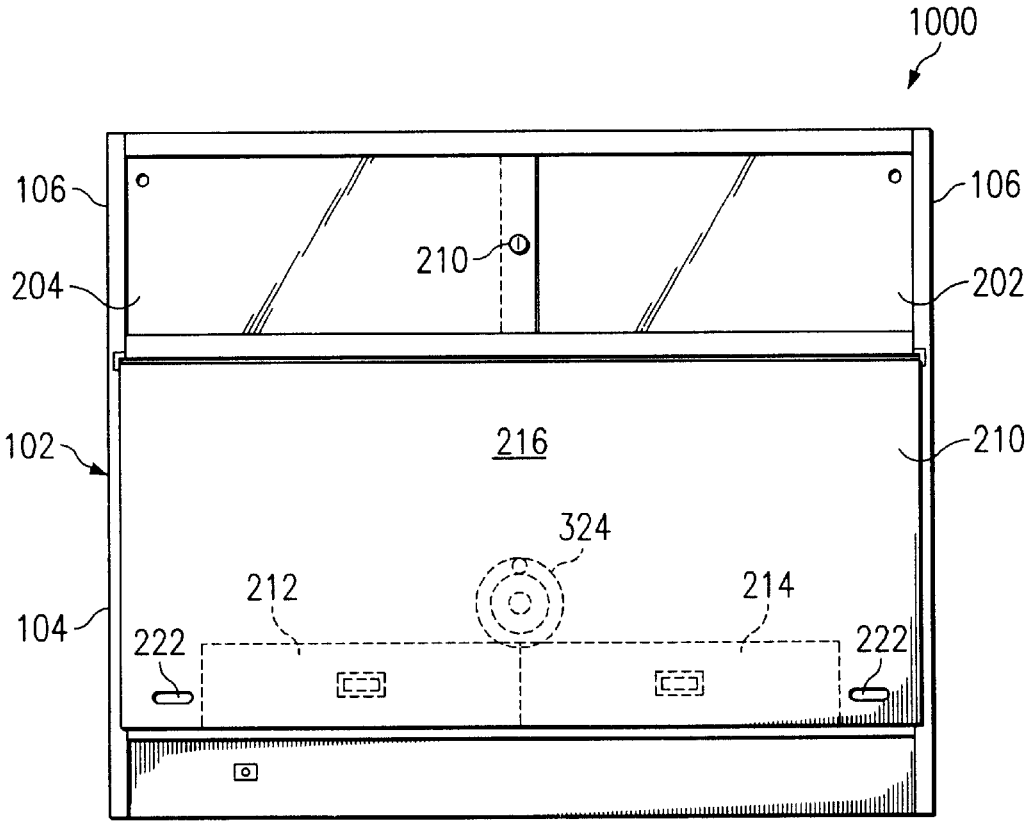
FIGS. 10–15 illustrate another embodiment of the display case security apparatus. Specifically.
Figure 11:
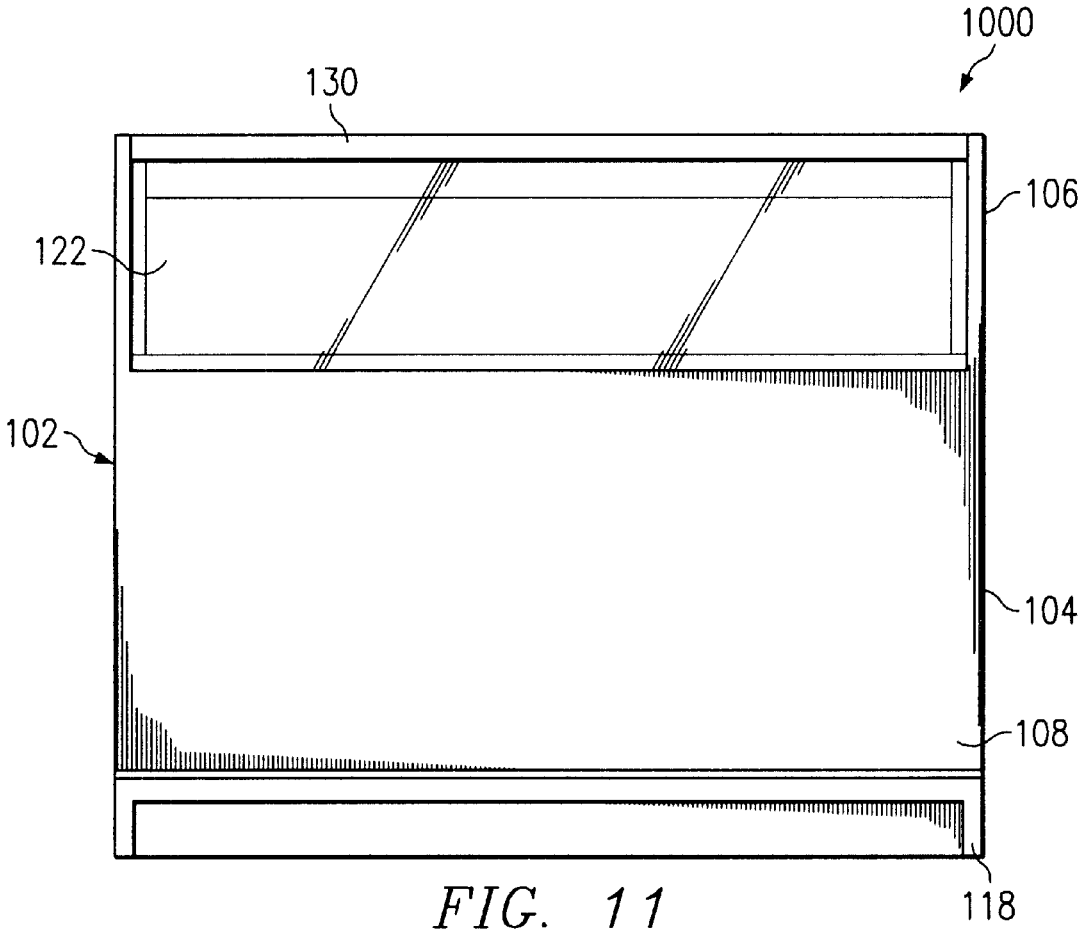
Figure 13:
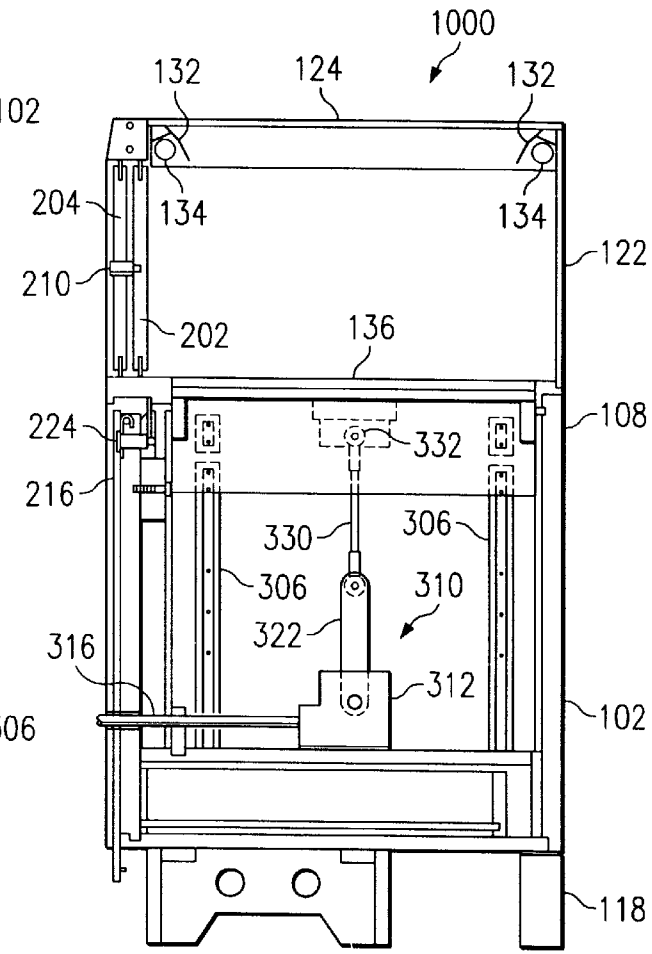
Figure 12:
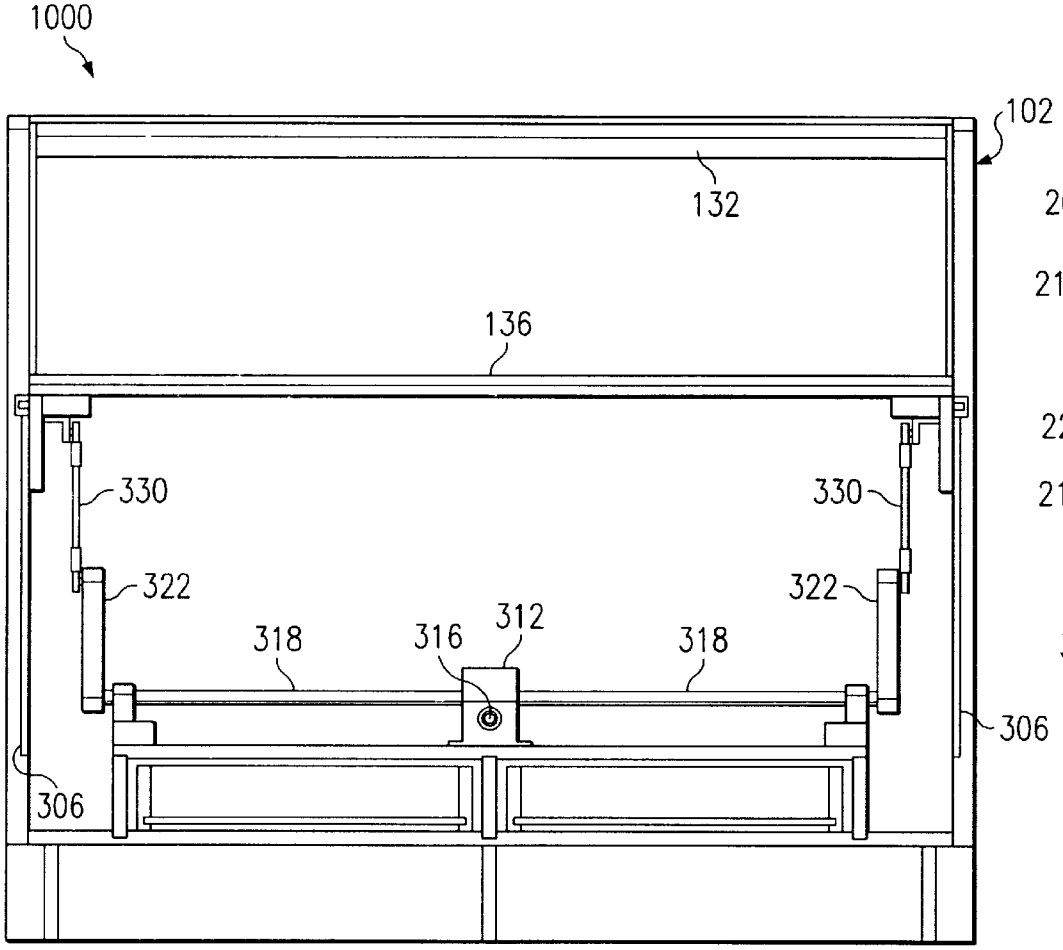
Figure 15:
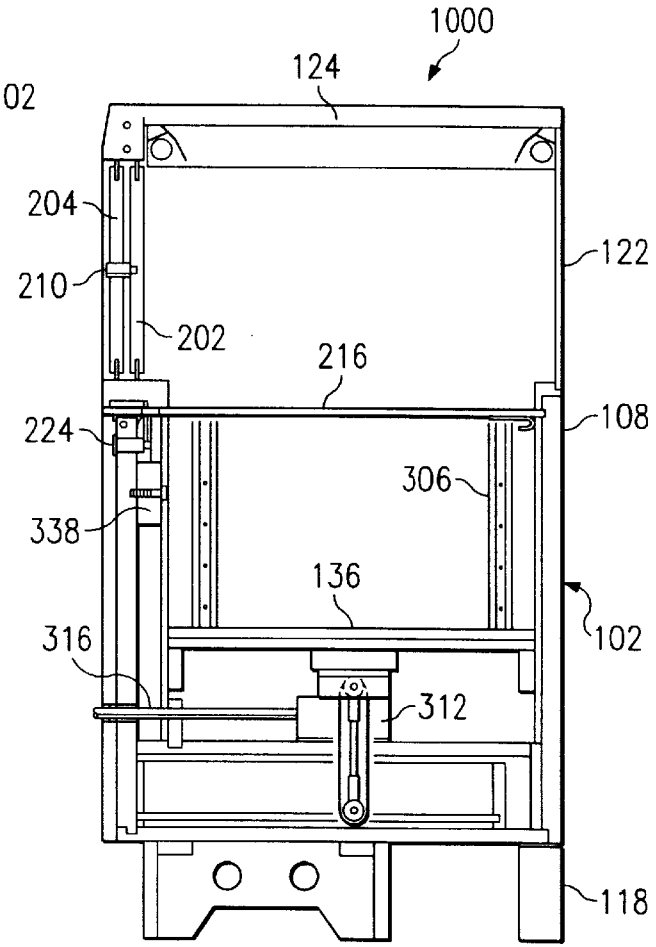
Figure 14:
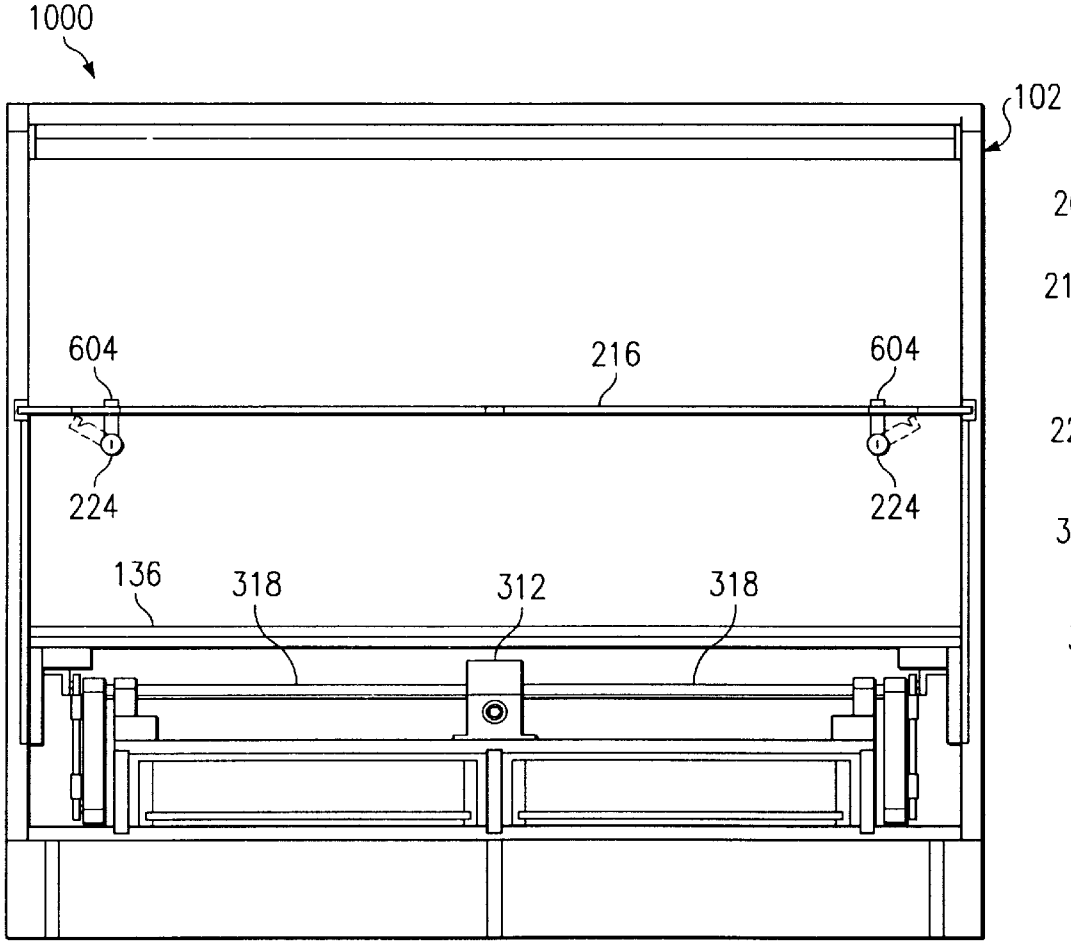
Figure 16:
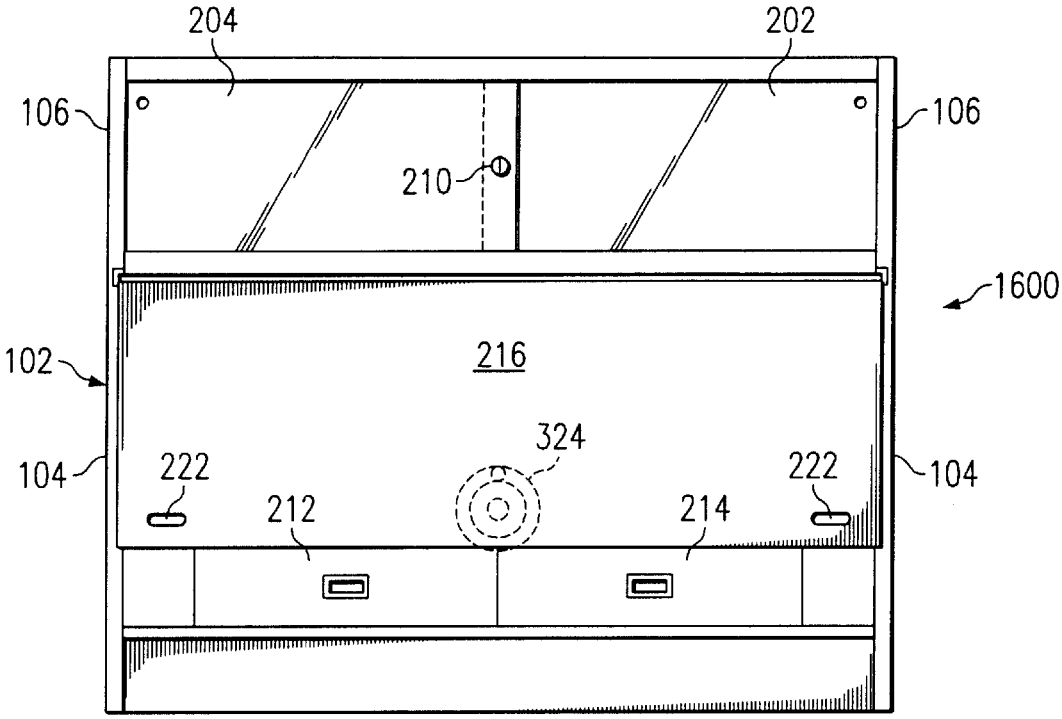
FIGS. 16–21 illustrate yet another embodiment of a display case security apparatus. Specifically.
Figure 17:
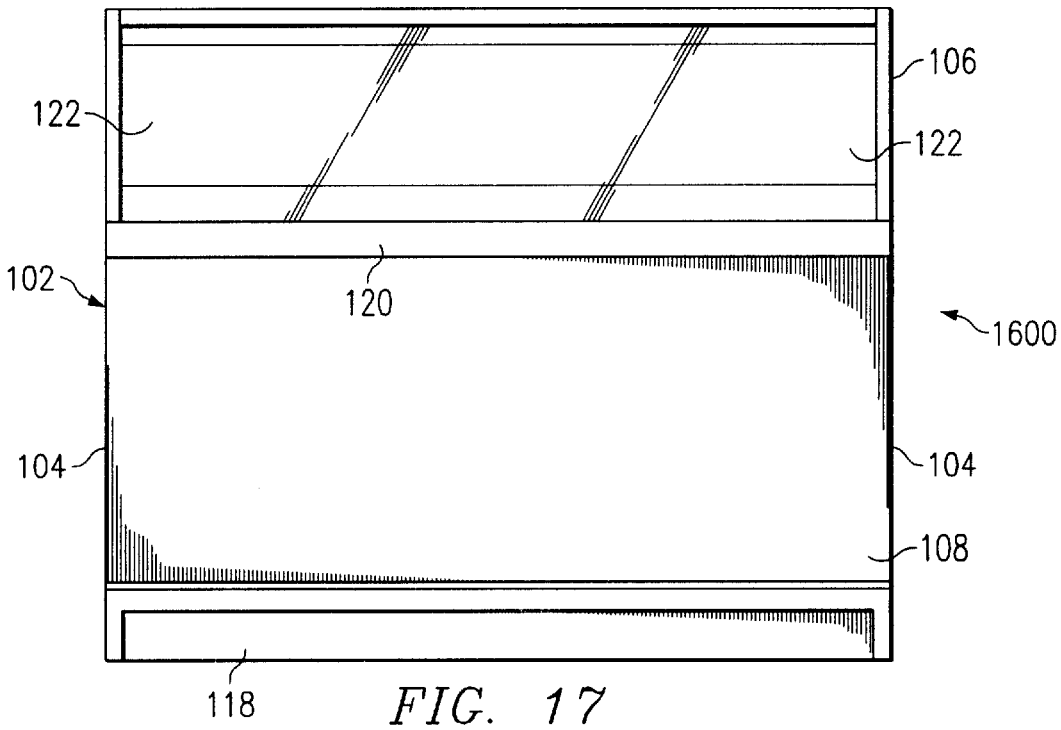
Figure 19:
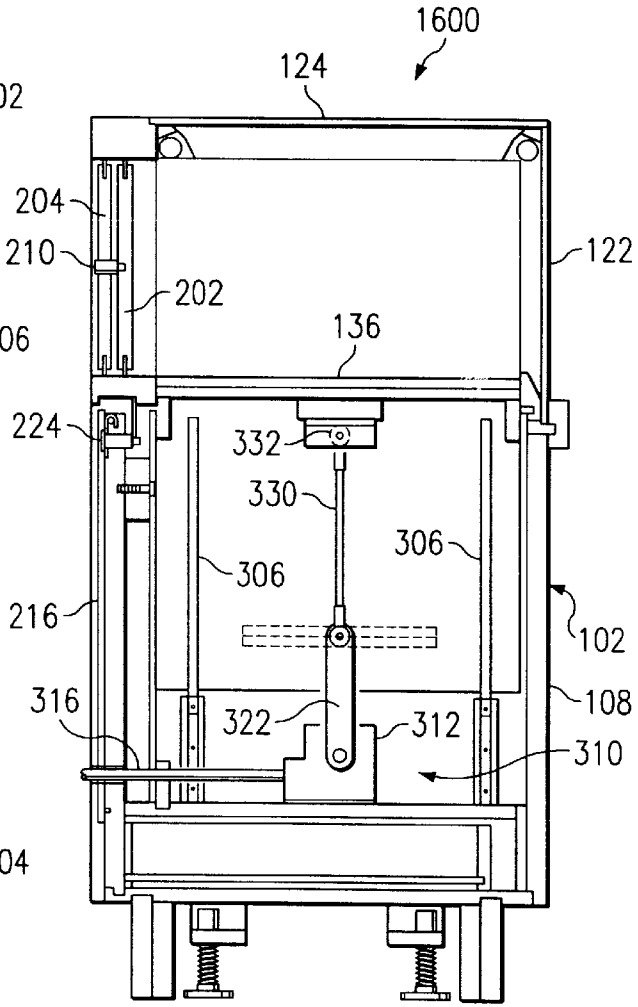
Figure 18:
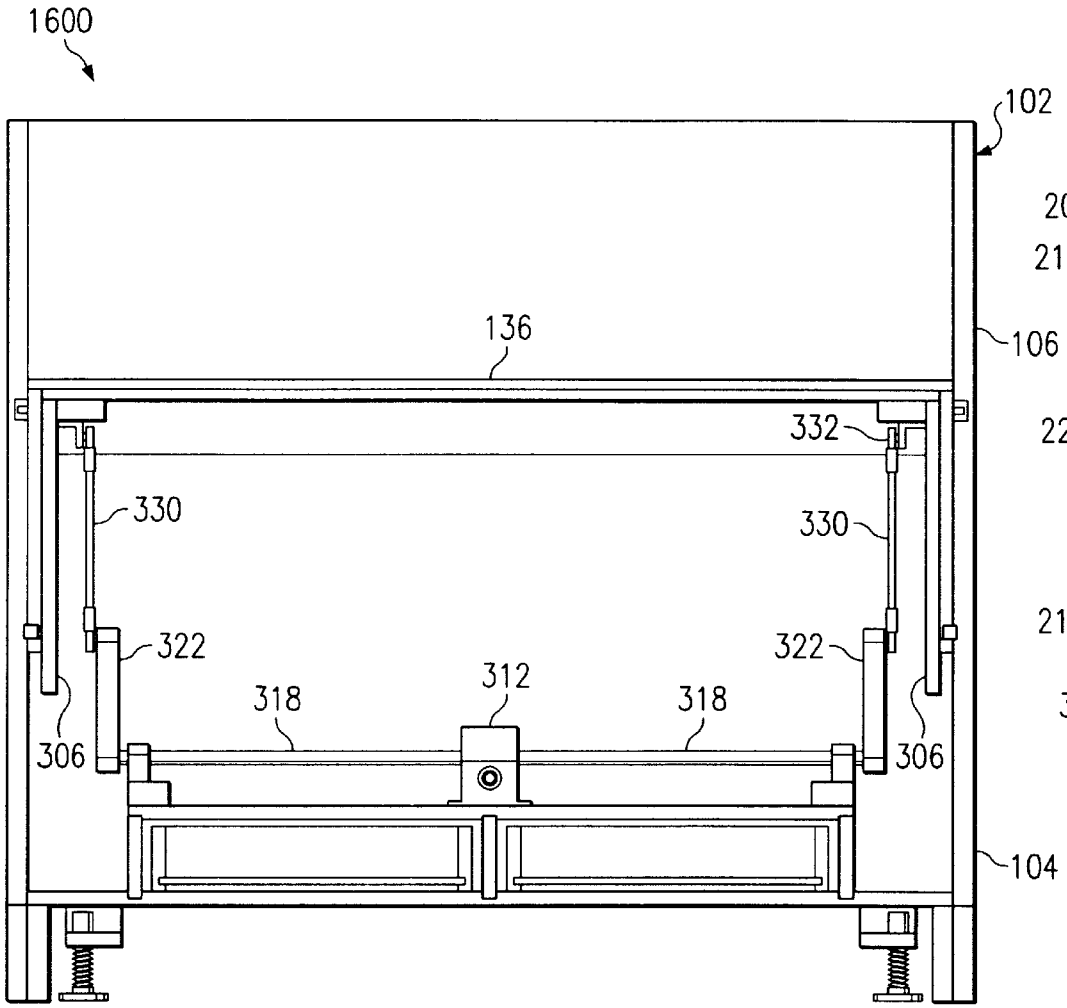
Figure 21:
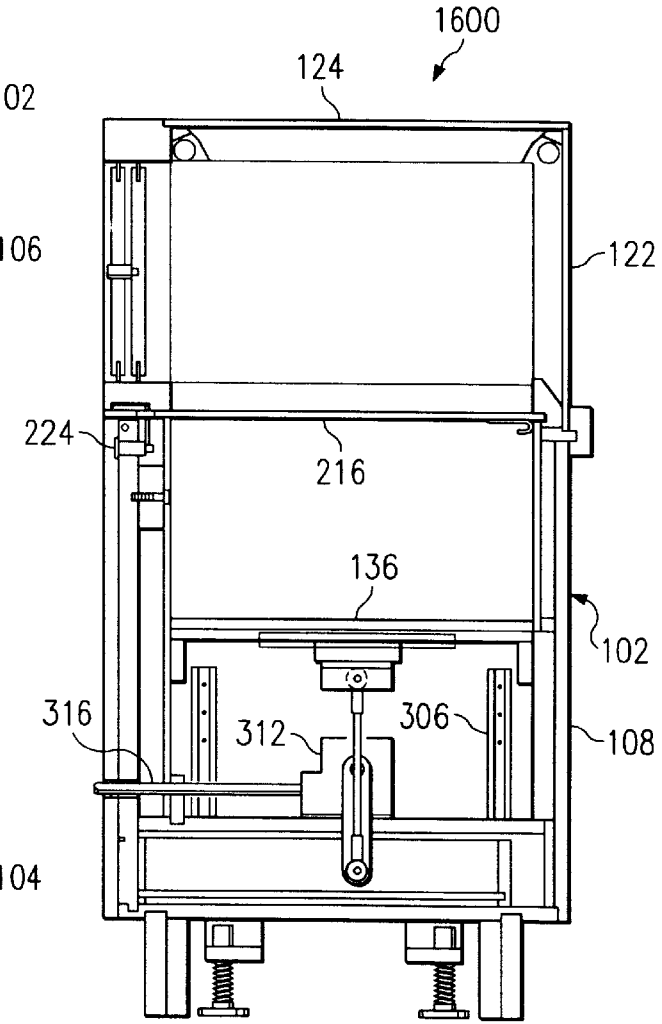
Figure 20:
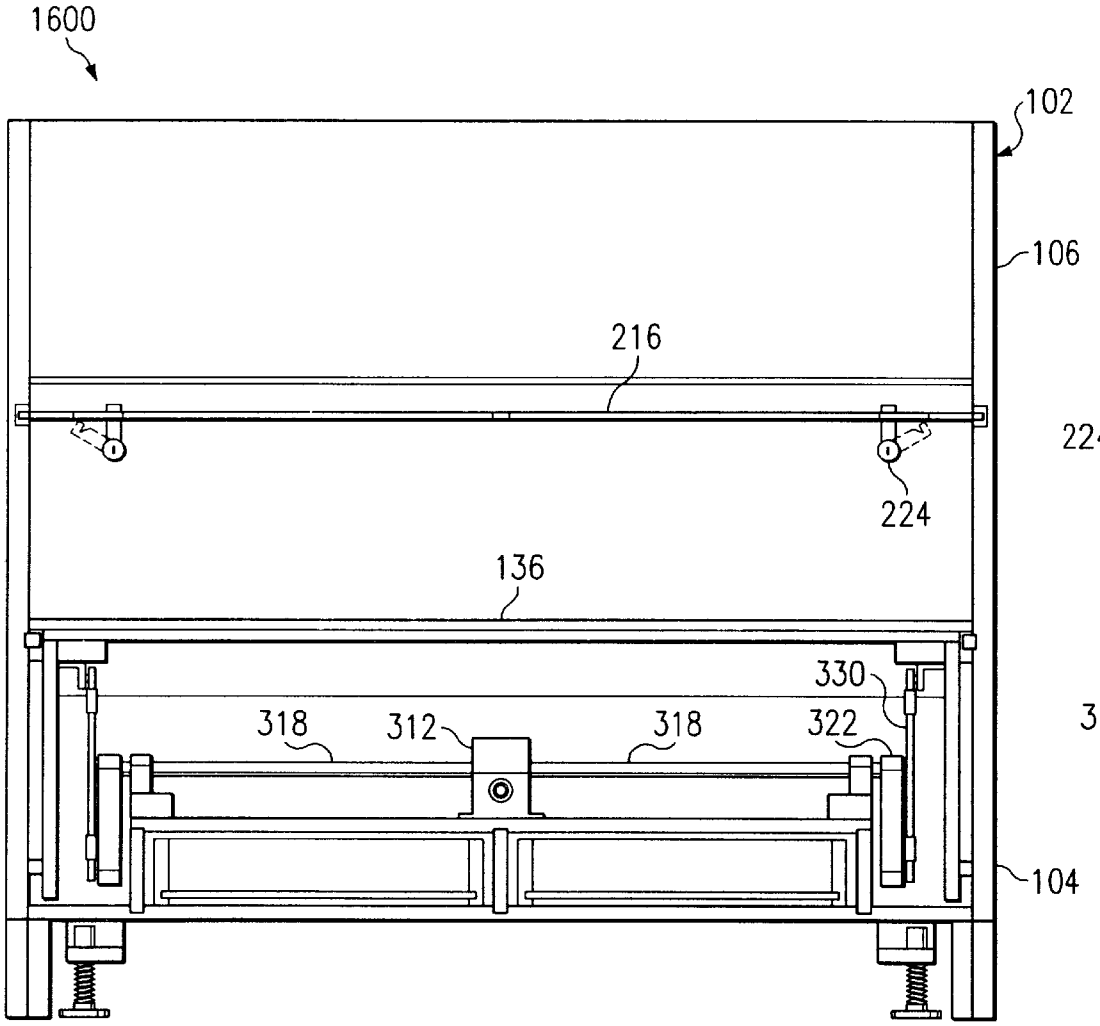

A reduction gear box 312 is mounted on the housing 314 for the convenience drawers 212, 214. An input shaft 316 engages the input portion of the reduction gear box 312 and one or more crankshafts 318 engage the output portion of the reduction gear box. As with any reduction gear box, a first number of rotations of the input shaft 316 will produce a second number of rotations of the crankshaft 318 where the first and second number constitute a predetermined ratio. In the display case security apparatus 100, it has been found that comfortable and convenient manual operation of the elevating mechanism can be obtained with a reduction gear box 312 having a ratio within the range from about 40:1 to about 80:1. In a more preferred embodiment, the predetermined ratio is within the range from about 50:1 to about 70:1. It will be appreciated that the reduction gear box 312 in the illustrated embodiment is a "right angle" drive, i.e., the axis of the input shaft 316 and the axis of the crankshaft 318 lie in planes which form an angle of about 90° to one another. This provides for the convenient orientation of the input shaft 316 near the rear wall of the case 102 such that an actuating device, e.g., a crank 320, a ratchet 322 (e.g., as shown in FIG. 7) or a wheel 324 (e.g., as shown in FIG. 10) can be inserted from the rear of the case to manually actuate the elevating mechanism 310.

The lift or elevating mechanism 310 further includes at least one pair of links. The first link 322 of each pair of links has a first end 324 which engages the crankshaft 318 so as to rotate with it and a second end 326 which is pivotally connected to a first end 328 of the second link 330. Each of the second links 330 has a second end 332 which is pivotally connected to the platform 136. In this case, brackets 334 are used to provide an interface between the second link 330 and the platform 136. Rotation of the crankshaft 318 moves the links 322, 330 of the elevating mechanism 310 whereby the platform 136 moves along the platform guide tracks 306 in a vertical motion as shown by arrow 308. This allows the platform 136 to move between the first position (e.g., FIG. 3) and the second position (e.g., FIG. 6). When the platform is in the second position, any articles 138 on the platform will now be disposed in the storage section 104 of the case, ready to be secured by the positioning of the closure plate 216.

If it is desired to provide positive stops on the elevating mechanism, these may be provided by forming notches 336 in the side plates 304 of the platform 136. These notches 336 engage fixed members, e.g., rear cross-member 338, when the platform 136 is in the first (i.e., fully-raised) position. Similarly, stops for the downward travel of the platform 136 may be provided. In alternative embodiments, travel stops may be provided by placing blocks which limit the travel of the first link 322 and/or the second link 330 of the elevating mechanism rather than by blocking [the platform] travel of the platform 136. In yet other embodiments, the links 322 and/or 330 may be selected such that the upper travel limit is defined by the top dead center (TDC) position of the two links and the lower travel limit is defined by the bottom dead center (BDC) position of the two links. In this situation, no physical stops are required to limit the travel of the platform 136 in the upward or downward direction. Further, when utilizing the TDC/BDC principle to define the upper and lower limits of platform travel, it is possible to complete both raising and lowering actions of the platform 136 while turning the input shaft 316 in a single direction, i.e., without reversing the direction of rotation for the input shaft or the direction of rotation of the crankshaft 318. In alternative embodiments where the elevating mechanism 310 is powered using an electric motor, use of the TDC/BDC principle would allow a single direction (i.e., non-reversing) electrical motor to be used for raising and lowering the platform 136. It will be appreciated that in such cases the crankshaft 318 rotates in a single direction while the platform 136 reciprocates up and down. This eliminates the need for a reversing switch or other circuitry to reverse the direction of the input shaft's rotation in order to reverse the direction of travel of the platform as is required in other types of elevating mechanisms.

Figure 8:
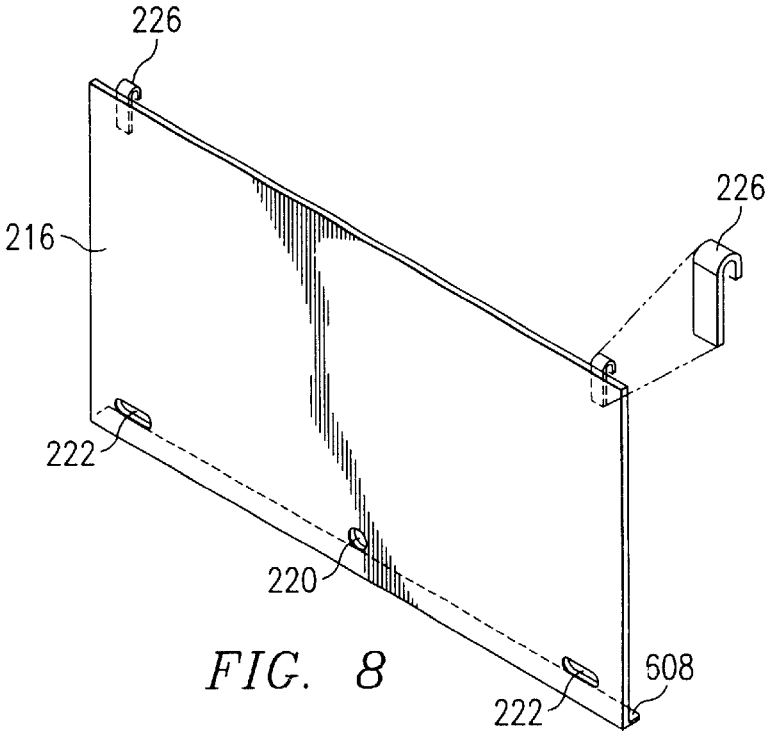
FIG. 8 is a perspective view illustrating the details of one embodiment of a closure plate including an enlarged view of the hinge.

Referring now to FIGS. 4–6, the display case security apparatus 100 is illustrated with the platform 136 in the second position, i.e., with the platform and displayed articles 138 disposed in the storage section 104 of the case 102. Once the platform has been moved into this position, the closure plate 216 may bemoved from its storage position, i.e., hanging against the back wall 114 of the case 102 and placed into the closure slot 218 between the display section 106 and the storage section 104. Referring now also to FIG. 8, there are illustrated details of the closure plate 216. In a preferred embodiment, the closure is a one-piece sheet of aluminum alloy having a generally uniform thickness within the range of about ⅛" to about ¼". A thickness of about 3⁄16" has proven to work well. By utilizing aluminum alloy, an extremely tough closure plate 216 is obtained, yet it is very light in weight such that the plate can be manually lifted from its rest position (FIG. 3) through the position designated "POS.A" in FIG. 6 to the generally horizontal designated position "POS.B" in FIG. 6, without putting undue strain on the salesperson performing the task. Once the closure plate 216 has been raised into the "POS.B"

configuration, it is simply pushed into place in the direction of arrow 602. It will be noted that as the closure plate 216 is pushed forward, the hinge hook 226 will automatically detach from the rear wall 114 of the case and move forward with the plate. Once the plate 216 has been put in the closed position, i.e., interposed between the display section 106 and the storage section 104, the cam locks 224 mounted on the rear wall 114 of the case can be activated. The latch 604 of the cam lock 224 moves through the latching slot 222 in the closure plate 216 and engages a slot in the structural member 606 immediately above the cam lock, thus preventing withdrawal of the closure plate. It will be noted that the lip 608 on the closure plate 216 extends downwards from the plate to prevent a criminal from attempting to defeat the cam lock latch 604.

Once the platform 136 has been moved into the second position and the closure plate 216 moved into position and locked using cam locks 224, articles 138 supported on the platform are protected from "smash and grab" theft. In fact, the case 102 appears empty as illustrated by FIG. 4. The display case security apparatus 100 provides additional security features to minimize the likelihood that a thief will be able to obtain access to the storage section 104 of the case in a short period of time. One example of such enhanced security features is the fact that the exterior walls of the lower storage section 104 are secured using no externally accessible fasteners. As best seen in FIG. 5, the rear wall 114 is secured to the interior cross-member 338 using a plurality of fasteners 340, which are inserted from the interior of cross-member 338. Thus, removing the rear wall 114 (which must be provided for in case maintenance on the elevating mechanism 310 is required) requires that the closure plate 216 be withdrawn, at which point, the fasteners 340 may be withdrawn from the interior side of cross-member 338, allowing wall 314 to swing backwards and disengage the slot 610 running across the bottom of the case.

Figure 9:
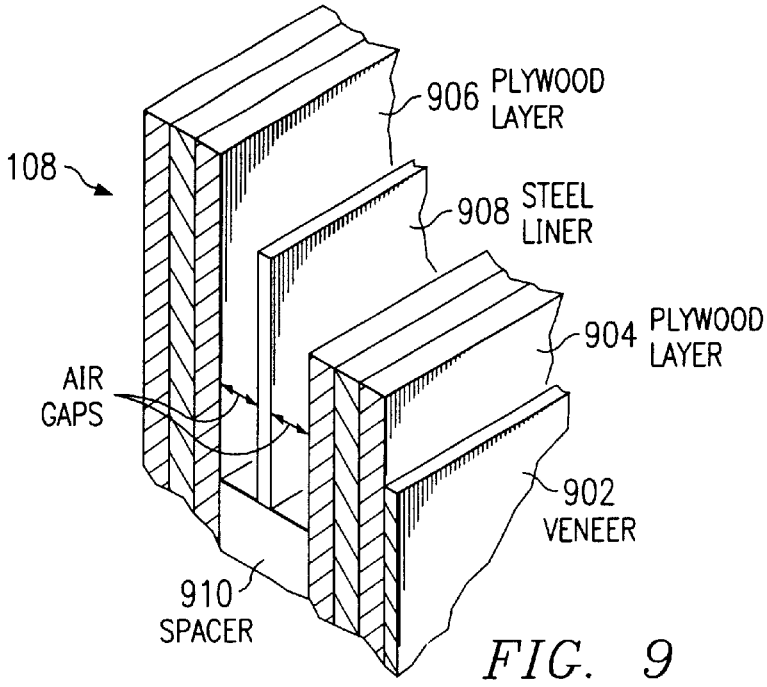
FIG. 9 is an enlarged cross-sectional perspective view of the lower storage section exterior wall.

Referring now to FIG. 9, there is illustrated an enlarged cross-sectional view of a portion of the exterior wall of the lower storage section 104, in this case a portion of the front wall 108. It is conventional to provide a shield or liner of thin metal inside the wooden cabinet. The metallic liner understood to provide additional protection against saw-through attacks against the case. In the prior art, however, the metallic liner is affixed to the interior of the wooden structure using fasteners such as rivets, bolts, nails, etc. It has now been discovered that this direct attachment of the liner to the cabinet structure actually reduces the effectiveness of the liner in preventing saw-through attacks. Thus, in the current invention, the metallic liner is not affixed to either the interior or exterior walls of the cabinet. Rather, it "floats" in a slot formed between two spaced-apart layers of cabinet material. In the example shown in FIG. 9, the exterior wall 108 comprises veneer 902 over a plywood panel 904 which is spaced-apart from an interior panel 906 which is also made of plywood. A thin metallic liner 908 is placed in the slot 910 between the two plywood layers 904, 906. The metallic liner 908 is not affixed to either layer 904 or 906, but merely rests within the slot 910 such that it may float if it is disturbed by, e.g., a reciprocating saw blade or other attack upon the cabinet. In one embodiment, the inner and outer plywood layers 906, 904 are formed of ¾" plywood material while the metallic liner 908 has a thickness of substantially less than 1/16". In another embodiment, the outer layer is made from ¾" plywood while the inner layer is made from ¼" melamine or other composite wood product. Again, a metallic liner having a thickness substantially less than 1/16" is placed in a slot formed between the two wooden layers but not firmly affixed to either layer.

Referring now to FIGS. 10–15, there is illustrated another embodiment of a display case security apparatus. The display case security apparatus 1000 has many elements which are substantially identical to those previously described for the display case security apparatus 100 (FIGS. 1–9). These elements are therefore denoted using the same reference numbers.

Referring now to FIGS. 16–21, there is illustrated another embodiment of a display case security apparatus. The display case security apparatus 1600 has many elements which are substantially identical to those previously described for the display case security apparatus 100,1000. These elements are therefore denoted using the same reference numbers.

Figure 22:
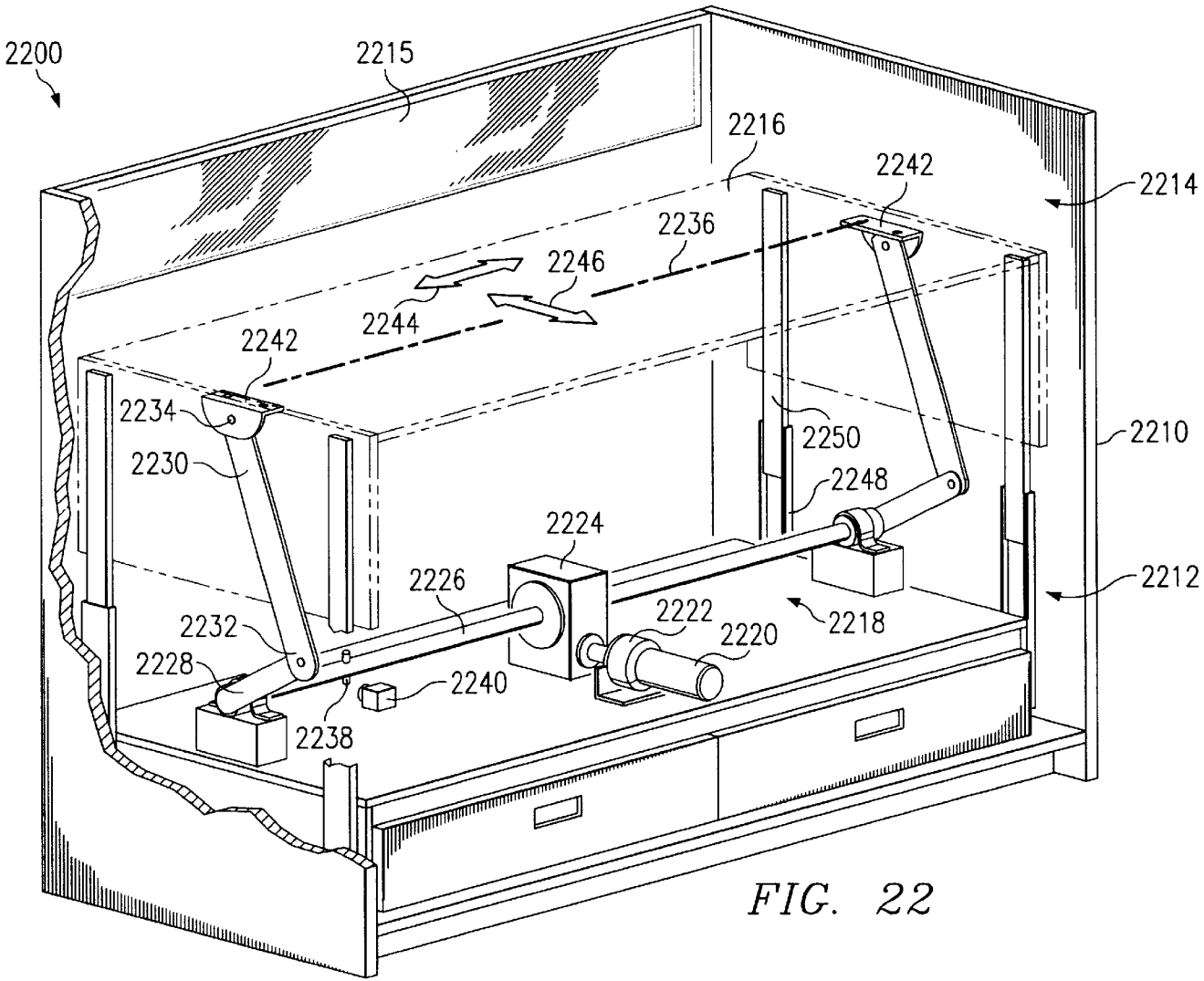
FIG. 22 is a rear perspective view of an yet another embodiment of a display case security apparatus with portions broken away for purposes of illustration.

Referring now to FIG. 22, there is illustrated yet another embodiment of a display case security apparatus, this embodiment incorporating an electrically powered lift mechanism. The display case security apparatus 2200 includes a housing 2210 including a lower storage section 2212 and an upper display section 2214 with transparent display window 2215. A movable platform 2216 (shown in broken line for purposes of illustration) is mounted in the housing using guides or slides 2248, 2250 which constrain the movement of the platform to vertical, i.e., up-and-down, motion only. The apparatus 2200 further includes an electrical elevating mechanism 2218 with an electric motor 2220 ("the Drive Motor") having an output shaft (not shown) that always rotates in the same direction (i.e., it does not reverse direction) during operation. The output shaft of the Drive Motor 2220 is connected to an in-line reduction gear mechanism 2222 ("the Primary Reducer"), which, in turn is connected to a right-angle reduction gear mechanism 2224 ("the Secondary Reducer") such that when the Drive Motor is operated, the output of the Secondary Reducer always rotates in the same direction. The output of the Secondary Reducer 2224 is connected to a crankshaft 2226, which, in turn has a crank arm 2228 connected to each end such that when Drive Motor 2220 is operated, the crankshaft 2226 rotates and the outer end of each crank arm 2228 revolves in a circle, always in the same direction. A connecting arm 2230 is pivotally connected between the outer end of each crank arm 2228 (at the point designated 2232) and the respective underside end of the movable platform 2216 (at the point designated 2234) to allow relative angular movement, but no sliding movement, between the respective components. When the Drive Motor 2220 operates, the lower end of each connecting arm 2230 revolves in a circle around the crankshaft (always in the same direction), thereby causing the upper ends of the connecting arms (which are attached to the platform 2216 that is constrained to move in the vertical direction only) to reciprocate, i.e., to move alternately up and down. The platform 2216, which is supported by the upper ends of the connecting arms 2230, is thereby alternately raised into the display section 2214 of the housing and lowered into the storage section 2212 of the housing as the Drive Motor 2220 operates in a single direction.

It will be appreciated that the elevating mechanism of this embodiment has no intrinsic stopping point while operating. Instead, as long as the Drive Motor 2220 operates (rotating in a single direction), the elevating mechanism will continuously raise and lower the platform 2216 without requiring the direction of rotation of any part of the mechanism to be reversed. Therefore, a cam member 2238 is disposed on the crankshaft 2226. The cam member 2238 cooperates with a sensor 2240, which may be a contact switch, a magnetic detector, an optical detector, or other such device, to determine the rotational position of the crankshaft 2226, and thus also the position of the platform 2216 such that the raising and lowering operation may be stopped at the desired point. It will also be appreciated that the elevating mechanism of this embodiment may be actuated to both raise and lower the platform using only a simple two-state switch (i.e., on—off). It will still further be appreciated that an electric motor of the type operated on AC electrical power or of the type operating on DC electric power may be employed for the Drive Motor 2220, depending upon the type of power available, preference of the user, or other considerations.

It will be further appreciated that the elevating mechanism of this embodiment has only two points of contact with the display platform 2216, namely at points 2242 where the connecting arms 2230 are connected to the underside of the platform along the longitudinal axis 2236 that runs in the side-to-side direction (i.e., as indicated by arrow 2244). These are insufficient, by themselves, to stabilize the platform 2216 in the front-to-back direction (indicated by arrow 2246). Consequently, the platform 2216 is stabilized in the front-to-back direction during raising and lowering by the drawer guides 2248, 2250 at each of the four corners of the platform.

Although several embodiments have been described in detail, it should be understood that various changes, substitutions and alterations can be made therein without departing from the spirit and scope of the invention as defined by the appended claims.

What is claimed is:

1. A display case security apparatus comprising:

a housing including a lower storage section and an upper display section disposed above the storage section, the storage section having an opaque exterior wall and the display section having an exterior wall which is at least partially transparent;

a plurality of platform guide tracks disposed on the interior of the housing;

a platform disposed within the housing and including a generally horizontal portion for supporting articles to be displayed, the platform being selectively movable between a first position, wherein any articles supported on the platform are displayed in the display section of the housing, and a second position, wherein any articles supported on the platform are stored in the storage section of the housing, the platform interfitting with the platform guide tracks so as to constrain the movement of the platform to vertical translation only;

an elevating mechanism mounted within the storage section and connected to the platform, the elevating mechanism including a rotatable crankshaft and at least one pair of links, the first link of each pair of links having a first end which engages the crankshaft so as to rotate with crankshaft and a second end which is pivotally connected to a first end of the second link of each pair of links, each of the second links having a second end which is pivotally connected to the platform, whereby the platform moves between the first position and the second position when the crankshaft rotates; and a closure that is selectively interposed between the display section and the storage section when the platform is in the second position, whereby the platform and any articles supported thereon are enclosed within the storage section of the housing.

2. The display case security apparatus of claim 1, wherein the elevating mechanism further includes an input shaft and a reduction gearbox having an input portion and an output portion, the input shaft engaging the input portion of the reduction gearbox and the crankshaft engaging the output portion of the reduction gearbox, whereby a first number of rotations of the input shaft will produce a second number of rotations of the crankshaft, the first and second number constituting a predetermined ratio.

3. The display case security apparatus of claim 2, wherein the predetermined ration is within the range from about 40:1 to about 80:1.

4. The display case security apparatus of claim 3, wherein the predetermined ration is within the range from about 50:1 to about 70:1.

5. The display case security apparatus of claim 2, wherein a vertical plane including the rotational axis of the input shaft forms an angle of about 90 degrees with a vertical plane including the rotational axis of the crankshaft.

6. The display case security apparatus of claim 2, wherein the input shaft is manually rotated to operate the elevating mechanism.

7. The display case security apparatus of claim 2, wherein the elevating mechanism further includes an electric motor operably connected to the input shaft to operate the elevating mechanism.

8. The display case security apparatus of claim 1, wherein the closure can be selectively detached from the housing and reattached to the housing without using tools.

9. The display case security apparatus of claim 1, wherein the closure is a rigid one-piece sheet.

10. The display case security apparatus of claim 8, wherein the closure is a sheet of aluminum alloy having a generally uniform thickness within the range from about ⅛ inch to about ¼ inch.

11. The display case security apparatus of claim 1, wherein portions of the exterior wall of the storage section include, when viewed in cross section from the exterior side to the interior side, a first sheet of wood product, a first air gap, a sheet of metal, a second air gap, and a second sheet of wood product, and wherein the first and second sheet of wood product are fixed with respect to one another while the sheet of metal can move within the air gap relative to both sheets of wood product.

12. The display case security apparatus of claim 11, wherein the first and second sheets of wood product are sheets of plywood, each sheet having a thickness within the range from about ½ inch to about ⅞ inch.

13. The display case security apparatus of claim 12, wherein the sheet of metal has a thickness which is less than about 1/16 of an inch.

14. A display case security apparatus comprising:

a housing including a lower storage section and an upper display section disposed above the storage section, the storage section having an opaque exterior wall and the display section having an exterior wall which is at least partially transparent;

a plurality of platform guide tracks disposed on the interior of the housing;

a platform disposed within the housing and including a generally horizontal portion for supporting articles to be displayed, the platform being selectively movable between a first position, wherein any articles supported on the platform are disposed in the display section of the housing, and a second position, wherein any articles supported on the platform are disposed in the storage section of the housing, the platform cooperating with the platform guide tracks so as to constrain the movement of the platform to vertical translation only;

an elevating mechanism mounted within the storage section and connected to the platform, the elevating mechanism including a rotatable crankshaft and at least one pair of links, the first link of each pair of links having a first end which engages the crankshaft so as to rotate with crankshaft and a second end which is pivotally connected to a first end of the second link of each pair of links, each of the second links having a second end which is pivotally connected to the platform, the lengths of the first and second links being selected such that continuous rotation of the crankshaft in a single direction causes the platform to move repeatedly between the first position and the second position; and a closure that is selectively interposed between the display section and the storage section when the platform is in the second position, whereby the platform and any articles supported thereon are enclosed within the storage section of the housing.

15. A display case security apparatus comprising:

a housing including a storage section and a contiguous display section;

the storage section having an obscuring exterior wall which does not permit the viewing of objects disposed therewithin;

the display section having an at least partially transparent exterior wall which permits the viewing of objects disposed therewithin;

a platform disposed within the housing for supporting articles to be displayed, the platform being selectively movable between a first position disposed within the display section and a second position disposed within the storage section;

an elevating mechanism mounted within the housing, the elevating mechanism including a rotatable crankshaft, a crank arm and a connecting arm;

a first end of the crank arm being fixedly attached to the crankshaft and a second end of the crank arm being spaced apart from the crankshaft;

a first end of the connecting arm being pivotally attached to the second end of the crank arm and a second end of the connecting arm being pivotally connected to the platform;

wherein continuous rotation of the crankshaft in a single direction causes the platform to move repeatedly between the first position and the second position.

16. A display case security apparatus in accordance with claim 15, further comprising:

an inlet shaft accepting input torque for the apparatus; and a reduction gearbox operably connected between the inlet shaft and the crankshaft, the gearbox multiplying the input torque received from the inlet shaft and transmitting the multiplied torque to the crankshaft.

17. A display case security apparatus in accordance with claim 16, wherein a longitudinal axis of the crankshaft is disposed at a right angle to a longitudinal axis of the inlet shaft.

18. A display case security apparatus in accordance with claim 16, further comprising:

an electric motor mounted within the housing and operably connected to the inlet shaft for supplying the input torque to the inlet shaft;

whereby rotation of the electric motor results in rotation of the crankshaft.

19. A display case security apparatus in accordance with claim 18, further comprising:

a cam projecting from the crankshaft; and a detector unit mounted proximate to the cam, the detector unit being capable of detecting the rotational position of the cam during at least a portion of the camshaft's rotation and supplying a control signal to the electric motor in response to the detected position.

20. A display case security apparatus in accordance with claim 19, wherein the detector unit comprises an electromechanical switch that is physically contacted by the cam during at least a portion of the crankshaft's rotation.

21. A display case security apparatus in accordance with claim 19, wherein the cam comprises a magnet and the detector unit comprises a magnetically-actuated switch that is activated by the cam during at least a portion of the crankshaft's rotation.

22. A display case security apparatus in accordance with claim 19, wherein the cam comprises an optical target and the detector unit comprises an optically-actuated switch that is activated by the cam during at least a portion of the crankshaft's rotation.

23. A method of raising and lowering a movable display platform within a display case security apparatus comprising a housing including a storage section and a contiguous display section, the storage section having an obscuring exterior wall which does not permit the viewing of objects disposed therewithin and the display section having an at least partially transparent exterior wall which permits the viewing of objects disposed therewithin, the method comprising the steps of:

a) mounting an elevating mechanism within the housing of a display case security apparatus, the elevating mechanism including a rotatable crankshaft, a crank arm and a connecting arm, a first end of the crank arm being fixedly attached to the crankshaft and a second end of the crank arm being spaced apart from the crankshaft, a first end of the connecting arm being pivotally attached to the second end of the crank arm;

b) pivotally connecting a second end of the connecting arm to a display platform that is mounted within the housing such that the display platform is selectively moveable between a first position disposed within a display section and a second position disposed within a storage section;

c) rotating the crankshaft in a first direction whereby the platform moves into the first position; and d) rotating the crankshaft further in the first direction whereby the platform moves into the second position.

24. A method in accordance with claim 23, wherein an electric motor is used for rotating the crankshaft in the first direction.

25. A method in accordance with claim 24, further comprising:

positioning a detector proximate to the elevating mechanism, the detector capable of detecting the position of the elevating mechanism during at least a portion of the crankshaft's rotation and supplying a control signal to the electric motor;

sensing the position of the elevating mechanism when the elevating mechanism is in a first predetermined position; and supplying a first control signal to the electric motor when the elevating mechanism is in the first predetermined position, the first control signal stopping rotation of the electric motor.

26. A method in accordance with claim 25, further comprising:

sensing the position of the elevating mechanism when the elevating mechanism is in a second predetermined position; and supplying the first control signal to the electric motor when the elevating mechanism is in the second predetermined position.

27. A method in accordance with claim 26, wherein the first predetermined position corresponds to the movable platform being in its first position disposed within a display section and the second predetermined position corresponds to the movable platform being in its second position disposed within the storage section.

* * * * *